United States Patent [19]

Shaw

[11] Patent Number: 4,856,952

[45] Date of Patent: Aug. 15, 1989

[54] DEFORMED BAR FOR ADHESION AND APPLYING TENSION

[75] Inventor: Roland J. Shaw, New Lambton Heights, Australia

[73] Assignee: Titan Mining & Engineering PTY. LTD., Sydney, Australia

[21] Appl. No.: 147,606

[22] Filed: Jan. 22, 1988

Related U.S. Application Data

[63] Continuation of Ser. No. 923,146, Sep. 18, 1986, abandoned.

[30] Foreign Application Priority Data

Jan. 25, 1985 [AU] Australia ..... PG9036

[51] Int. Cl.[4] ..... F16B 35/04

[52] U.S. Cl. ..... 411/413; 411/82; 411/421

[58] Field of Search ..... 411/82, 258, 388, 389, 411/411–413, 415, 421; 405/259–261; 52/737–740

[56] References Cited

U.S. PATENT DOCUMENTS

| | | | |
|---|---|---|---|
| 2,562,516 | 7/1951 | Williams | 411/421 |
| 4,479,748 | 10/1984 | Uhlmann | 411/421 |
| 4,584,247 | 4/1986 | Mulholland | 411/411 |

FOREIGN PATENT DOCUMENTS

| | | | |
|---|---|---|---|
| 50224 | 2/1969 | Australia . | |
| 74446 | 8/1980 | Australia . | |
| 85482 | 10/1981 | Australia . | |
| 85483 | 10/1981 | Australia . | |
| 81563 | 3/1982 | Australia . | |
| 1484229 | 2/1964 | Fed. Rep. of Germany . | |
| 1194552 | 6/1965 | Fed. Rep. of Germany | 411/421 |
| 3145923 | 11/1981 | Fed. Rep. of Germany . | |

OTHER PUBLICATIONS

International Search Report of PCT/AU 86/00014.

*Primary Examiner*—Neill R. Wilson

*Attorney, Agent, or Firm*—Armstrong, Nikaido, Marmelstein & Kubovcik

[57] ABSTRACT

A rock-bolt bar having raised deformation its entire length and having an end portion threaded to receive a standard helically threaded nut. The raised deformations are all raised to the same height above a minor diameter of the bar and the depths of the threaded portions of the raised portions do not extend to the minor diameter. The equal height raised portions may be of various configurations, all extending longitudinally the entire length of the bar.

5 Claims, 3 Drawing Sheets

FIG 1
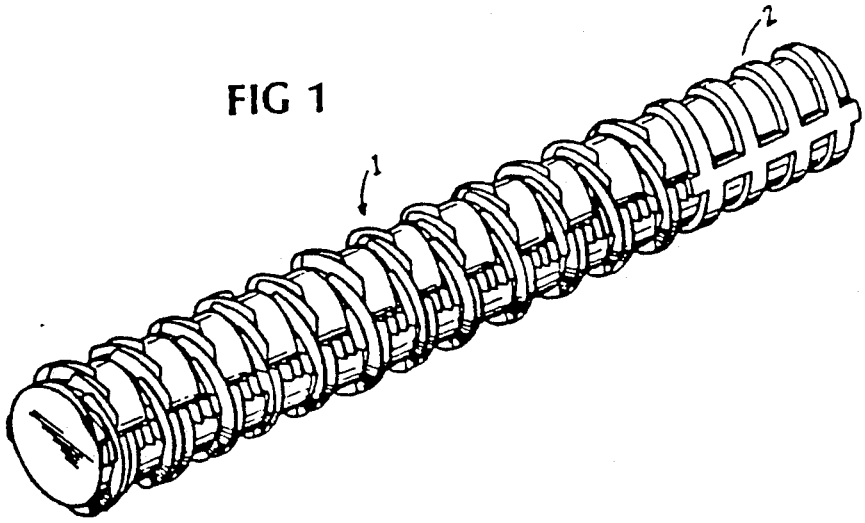
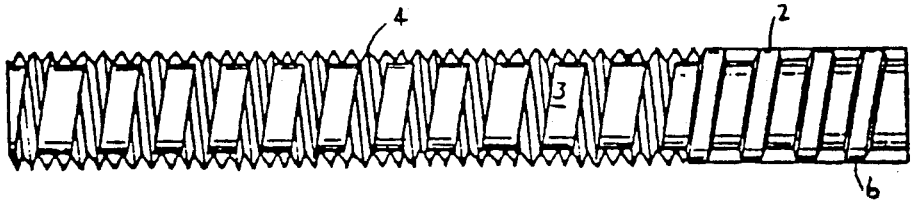
FIG 2
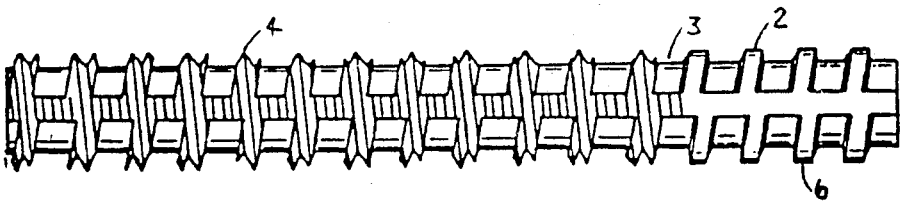
FIG 3
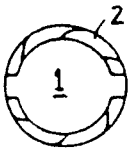
FIG 4

DEFORMED BAR FOR ADHESION AND APPLYING TENSION

This application is a continuation of Ser. No. 923,146 filed Sept. 18, 1986, now abandoned.

TECHNICAL FIELD

This invention relates to deformed bars which have particular application in the mining engineering field as rock bolts useful in mechanical or chemical anchoring situations.

BACKGROUND ART

Deformed bars are well known in the art. For example, Australian Design Registration No 85482 depicts a deformed bar having a longitudinal rib and spiral deformations, the spirals being fully mismatched on either side of the rib. By comparison. Australian Design Registration No 85483 depicts a deformed bar having a longitudinal rib and spiral deformations which are only slightly mismatched on either side of the rib.

Further, deformed bars with hot rolled threads are known. Australian Pat. No. 438,788 teaches such a bar which has a continuous spiral and is capable of being cut in any position for the application of a specially fabricated nut. The deformed bar taught by No. 438,788 is known in the art as the "Dywidag" bar and the specially fabricated nut essential for use with this bar as the "Dywidag" nut.

The application of a thread to a deformed bar is taught by Australian Pat. No. 536,627.

It is an object of this invention to provide an improved threaded deformed bar.

DISCLOSURE OF INVENTION

This invention in one broad form provides a deformed bar having either a continuous or a discontinuous spiral deformation, the dimensions of said deformation being such that a thread can be rolled on said deformation, or on part only thereof, without penetration of said thread to the minor dimension of said bar in the recess between succesive portions of said spiral.

The invention also provides a deformed bar incorporating such a thread.

It will be appreciated by the man skilled in the art that a considerable reduction in steel content is characteristic of a bar of this invention, compared with conventional threaded deformed bars. For example, a bar according to this invention may comprise a 24 mm thread rolled on a nominal 20 mm diameter bar. It would be necessary to use a 21.7 mm diameter bar if a 24 mm thread were required to be rolled on a solid bar or a bar in accordance with Australian Patent No. 536,627. Savings of steel are in evidence to the extent of approximately 17%. Obviously, the bar of the current invention permits upgrading of the steel from which it is fabricated to suit a particular process requirement.

The bar of the present invention is also designed so that it can be cut at any portion and a special nut fitted.

Advantages of the bar of the current invention are numerous.

The invention allows employment of a bar with a smaller average diameter than a conventional bar, in normal bolting practice with consequent saving of steel. This results from the fact that the average area of the bar is less than the average area of thread as would be applied to a normal bar. The strength of a bar of this invention can be made equivalent to that of existing bolts by appropriate material selection. This results from the fact that the bar of this invention employs the standard thread only on the crests of a spiral deformation.

The bar of this invention lends itself to the intial use of a normal nut on a secondary thread although in subsequent use a "Dywidag" type nut may be employed. The nut used in the previously referred to "Dywidag" bar is specially fabricated and expensive of manufacture compared with a standard nut. In some operations, long lengths of "Dywidag" bar are used as a bolt and when one is blasted the bar is cut and a new nut fitted. The present invention provides the opportunity of using a low cost standard nut in the first instance, followed by use of a special nut on subsequent cutting and refitting. Thus the bar of this invention can be processed with a reduced amount of steel for a given rock bolt size and may also incorporate deformations in the form of a hot rolled thread.

The bar of this invention can be further processed without intermediate operation to provide a standard thread, whilst achieving the above specified benefits.

A bar of this invention provided with a left hand spiral deformation is intended to mix resin anchors during right-hand rotation of the bolt and also offer greatly improved bond strength with cement or resin anchors, compared with known bolts. Other deformation patterns are useful within the context of this invention, e.g. a right hand spiral or annular rings.

In use, when a bolt according to this invention is inserted in a drill hole in a mine roof, if the exposed bolt end has a forged head or driving device in place of a rolled thread, then the bolt may still be used as a tensioning member, not simply as a grouted dowel. The following installation procedure describes a typical application for a left hand spiral threaded deformed bar bolt according to this invention.

1. Insert resin anchor in hole followed by bolt with the plate washer preplaced and resting on the shoulder of the forged head or mixing device.

2. Spin the bolt clockwise and thrust through the resin (or cement) anchor for a time specified by the anchor manufacturer. The bolt is positioned so that the plate washer is in loose contact with the immediate roof. Hold the bolt in position until anchor has set.

3. Rotate the bolt anticlockwise up to a prescribed torque. The bolt is able to use the resin as a moulded thread and hence can be "screwed" into the roof thus applying tension to the bolt and compression to the roof.

Ultimately, the improved threaded deformed bar of this invention will be useful in a typical rock bolt application, in hard rock mining, with a 150 mm thread. An initial conventional and relatively inexpensive first nut will be used, and after severance of the bolt after removal of mining material, a longer (coarse) nut may be placed on the remaining unthreaded rock bolt section. Use of an initial inexpensive standard nut will save, at current rates, approximately $1.50 per rock bolt installation.

BRIEF DESCRIPTION OF DRAWINGS

By way of example only certain preferred embodiments of a threaded deformed bar of this invention will now be described with reference to the accompanying drawings, wherein:

FIG. 1 is a perspective view of a threaded deformed bar of this invention depicting a slightly mismatched spiral;

FIG. 2 is a plan view of the bar of FIG. 1;

FIG. 3 is a side view of the bar of FIG. 1;

FIG. 4 is an end view of the bar of FIG. 1;

MODES OF CARRYING OUT THE INVENTION

Figure 5:
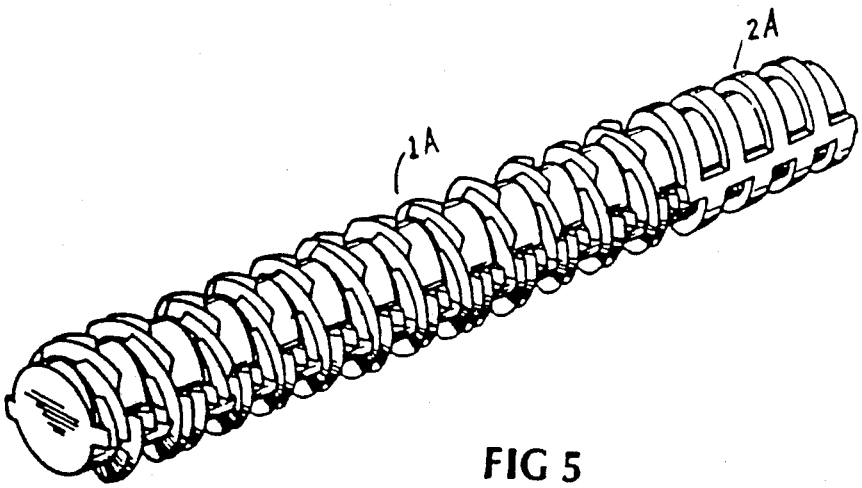
FIG. 5 is a perspective view of a threaded deformed bar of this invention, exhibiting a fully mismatched spiral.
Figure 6:
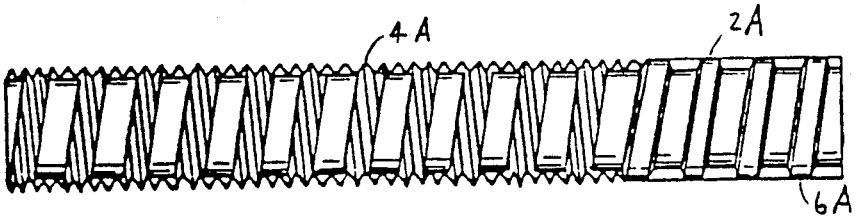
FIG. 6 is a plan view of the bar of FIG. 5.
Figure 7:
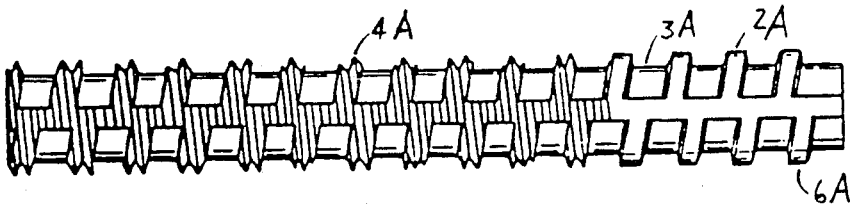
FIG. 7 is a side view of the bar of FIG. 5.
Figure 8:
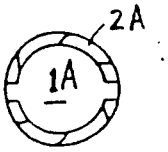
FIG. 8 is an end view of the bar of FIG. 5.
Figure 9:
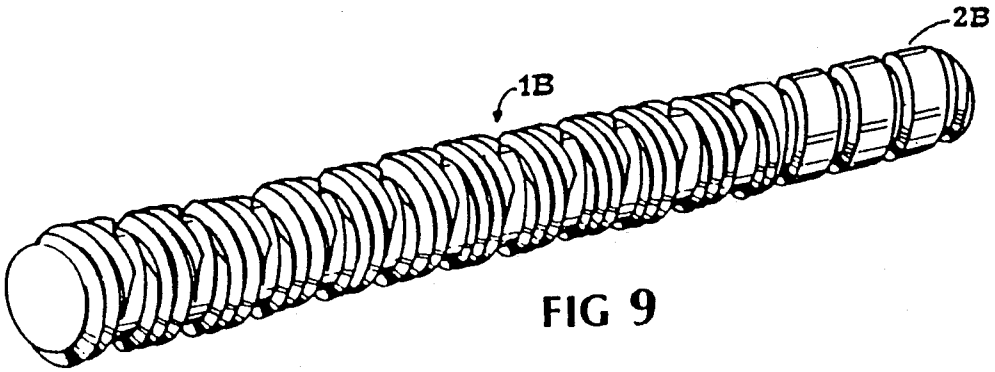
FIG. 9 is a perspective view of a threaded deformed bar of this invention, showing a perfect spiral.
Figure 10:
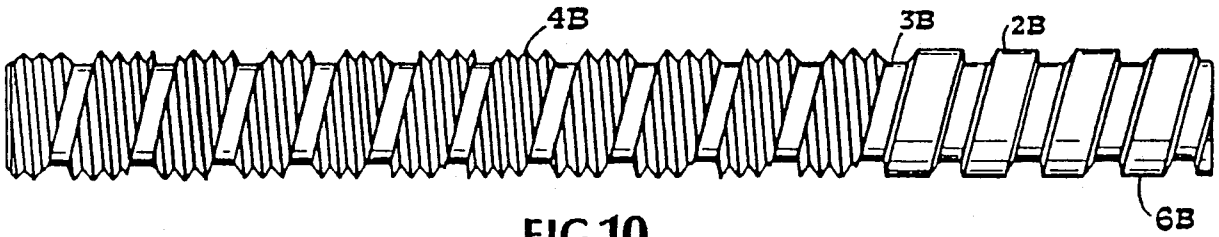
FIG. 10 is a side view of the bar of FIG. 9.
Figure 12:
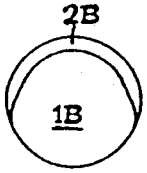
FIG. 12 is an end view of the bar of FIG. 9.
Figure 11:
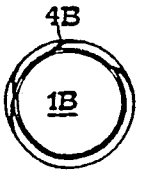
FIG. 11 is a front view of the bar of FIG. 9.

It will be appreciated that the bars depicted in perspective views in FIGS. 1, 5 and 9 constitute three embodiments of this invention. In the following description the numerals 1, 2, 3 . . . are used in relation to the embodiment of FIGS. 1 to 4, the numerals 1A, 2A, 3A . . . indicate corresponding parts of the embodiment of FIGS. 5 to 8 and the numerals 1B, 2B, 3B . . . indicate corresponding parts of the embodiment of FIGS. 9 to 12.

In the drawings, the bar generally depicted at 1, 1A, 1B incorporates a discontinuous spiral deformation 2, 2A or a continuous spiral deformation 2B with intermediate recessed bar portion 3, 3A, 3B. Part 4, 4A, 4B only of the deformation 2, 2A, 2B is threaded to accommodate a standard nut. It should be noted that this thread does not extend into recesses 3, 3A, 3B. Each of the embodiments of this invention allows considerable savings in steel compared with prior art steel bars. Deformities 2, 2A and 2B are of sufficiently substantial height and width to allow threading of the deformed portions only of bar 1, 1A, 1B, recessed portions 3, 3A, 3B being unthreaded. This allows an approximately 17% steel saving compared with standard bars.

When a threaded deformed bar according to the embodiment of this invention depicted in FIGS. 9, 10, 11 and 12 is used as a roof bolt, a standard nut is used for initial installation and is located on threaded bar portion 4B. When material is extracted from the mine roof around such a bolt, the bolt is severed in the region of the spiral deformity which is unthreaded, 6B. A larger nut is then used to tension the remaining bolt portion. This embodiment is therefore the most preferred form of this invention.

Also within the scope of this invention are unthreaded deformed bars which, when threaded, result in the threaded deformed bars depicted in the embodiments.

I claim:

1. A length of substantially circular cross-section rock-bolt bar having a rolled deformation located thereon; said deformation comprising raised surfaces above a minor diameter of said bar; at least one end portion of said length having a standard, helically threaded portion of constant maximum depth included in said raised surfaces; said threaded portion being receivable of a correspondingly standard helically threaded nut thereon; said maximum depth of said threaded portion not extending in depth to said minor diameter; and wherein said deformation is formed by continuous rolling and said thread is formed by machining with no intermediate processing steps occurring between said formation steps; said rolled deformation thereby providing a basis for said threaded portion to be of a larger nominal thread diameter than that possible to be otherwise applied to said rock-bolt bar, said raised surfaces of said deformation comprising a plurality of pairs of opposed semi-circumferential strips of predetermined width raised a predetermined height above said minor diameter; opposed ends of said pairs being joined by respective longitudinal strips also raised the same predetermined height; said opposed ends being offset longitudinally so that said opposed ends partially overlap in a logintudinal direction.

2. A length of substantially circular cross-section rock-bolt bar having a deformation located thereon; said deformation comprising raised surfaces all of equal lateral dimension above a minor diameter of said bar and extending the entire length of said bar; at least one end portion of said length having a standard, helically threaded portion of constant maximum depth included in said raised surfaces; said threaded portion being receivable of a correspondingly standard helically threaded nut thereon; said maximum depth of said threaded portion not extending in depth to said minor diameter; said deformation thereby providing a basis for said threaded portion to be of a larger nominal thread diameter than that possible to be otherwise applied to said rock-bolt bar, said raised surfaces of said deformation comprising a plurality of pairs of opposed semi-circumferential strips of predetermined width raised a predetermined height above said minor diameter; opposed ends of said pairs being joined by respective longitudinal strips also raised the same predetermined height.

3. A length of substantially circular cross-section rock-bolt bar having a deformation located thereon; said deformation comprising raised surfaces all of equal lateral dimension above a minor diameter of said bar and extending the entire length of said bar; at least one end portion of said length having a standard, helically threaded portion of constant maximum depth included in said raised surface; said threaded portion being receivable of a correspondingly standard helically threaded nut thereon; said maximum depth of said threaded portion not extending in depth to said minor diameter; said deformation thereby providing a basis for said threaded portion to be of a larger nominal thread diameter than that possible to be otherwise applied to said rock-bolt bar, said raised surfaces of said deformation forming a continuous spiral suitable for receiving a coarsely threaded nut thereon.

4. A length of substantially circular cross-section rock-bolt bar having a spiral rolled deformation located thereon throughout the entire length of said bar, said spiral rolled deformation comprising raised surfaces above a minor diameter of said bar; at least one end portion of said length having a standard helically threaded portion included in said raised surfaces, said threaded portion being receivable of a correspondingly standard helically threaded nut thereon; said maximum depth of said spiral rolled deformation including at least one strip of substantially the same height as said raised surfaces and extending longitudinally along said entire length of said bar.

5. The length of bar as claimed in claim 4 wherein said standard helically threaded portion in said raised surfaces is of constant maximum depth and has a hand which is opposite to that of said spiral rolled deformation.

* * * * *